US006065610A

United States Patent [19]

Elmore

[11] Patent Number: 6,065,610

[45] Date of Patent: May 23, 2000

[54] MANUAL SORTING APPARATUS FOR PAPER PRODUCTS

[75] Inventor: Phillip Elmore, Palm Beach Gardens, Fla.

[73] Assignee: Savasort, Inc., West Palm Beach, Fla.

[21] Appl. No.: 09/230,068

[22] PCT Filed: May 20, 1997

[86] PCT No.: PCT/US97/08471

§ 371 Date: Jan. 19, 1999

§ 102(e) Date: Jan. 19, 1999

[87] PCT Pub. No.: WO98/52702

PCT Pub. Date: Nov. 26, 1998

[51] Int. Cl.[7] ..... B42F 17/00

[52] U.S. Cl. ..... 211/10; 211/11

[58] Field of Search ..... 211/10, 11, 50, 211/184, 53, 54.1, 57.1, 58

[56] References Cited

U.S. PATENT DOCUMENTS 1,254,930 1/1918 Page .
3,966,050 6/1976 Dahl ..... 211/10
4,043,276 8/1977 Dahl .
4,669,277 6/1987 Baxter .
4,763,795 8/1988 Metzger et al. .

FOREIGN PATENT DOCUMENTS 800230 1/1936 France .

*Primary Examiner*—Daniel P. Stodola
*Assistant Examiner*—Erica B. Harris
*Attorney, Agent, or Firm*—Malin, Haley & DiMaggio, P.A.

[57] ABSTRACT

A device for manually sorting paper products includes a rigid lower divider support base holding a plurality of essentially flat, planar, semi-flexible dividers. The dividers are slidably held within the divider support base to provide adjustability in sorting articles of varying thicknesses. In one embodiment, each divider rotates forward and rearward within the divider support base to position and view the contents held within the dividers. The dividers include at least one protruding recessed shoulder to engage a channel in the divider support base to retain the divider in place in the forward or open position. In another embodiment, the dividers are maintained in a vertical position and are slidably held within the divider support base. The dividers can each include an indexing tab on an upper portion.

10 Claims, 8 Drawing Sheets

MANUAL SORTING APPARATUS FOR PAPER PRODUCTS

BACKGROUND OF THE INVENTION

1. Field of the Invention

This invention relates to improvements in manual sorting devices for organizationally separating paper products, including individual sheets of paper, files, invoices, statements, and other single or multiple sheets of paper. The apparatus includes a rigid, planar support base for supporting a plurality of flat, self-standing dividers. Specifically, the present invention deals with improvements in the divider and its operation with the divider support base and with reference tabs.

2. Description of Related Art

Manual sorters for paper products are well known in the art. Devices of this type typically include a rigid base that holds a plurality of thin, planar dividers, each having a reference tab.

Sorters are designed in two different operational styles, based on the orientation of the dividers as they rest in the support base.

A vertical manual sorter has a plurality of dividers that stand substantially upright, and permit longitudinal expansion along the support base.

A flat manual sorter has a plurality of dividers that lie essentially horizontally against each other and the supporting base. The flat sorter typically is not expandable along the support base.

The vertical and flat style divider support bases both have rigid, typically flat, elongated support bases that include parallel channels, one on each side of the divider support base, that receives engaging elements, each formed as part of each divider along the divider bottom to movably anchor and retain each divider in the support base.

In order to use either type of sorter, vertical or flat, each divider must be somewhat movable relative to adjacent dividers to provide manual separation between adjacent dividers for insertion or extraction of the sheet of paper to be filed or extracted.

In the vertical style sorter, each divider is also movable longitudinally relative to the divider support base to allow expansion of space between the vertical dividers, if desired, to expand a particular area between dividers to receive a larger volume of paper sheets.

When looking at a flat sorter, one problem that arises deals with the rotational positioning of the divider. Each divider in a flat sorter is held in place by gravity and when it is manually raised rotationally to insert or remove an item, the divider must be constantly held in position. The user opening a flat divider section may wish the divider to remain in an open position while working with the sorter. Often, a user may place a foreign object to spread apart the dividers while operating the device. Thus, it would be desirous to have a flat sorter, wherein an individual divider could be positioned in an expanded or open position for a short period of time during the use of the device.

When using a vertical sorter, each divider should stand firmly in place vertically while allowing some slight rotational movement for opening areas between dividers for placing or extracting paper sheets disposed therein.

In all sorters, it is also desirable for the user to be able to instantly recognize the desired specific divider section, whether it be alphabetical or numerical for ease of operation of the device.

The present invention overcomes problems in the prior art by providing an improved manual sorter for both vertical and flat sorters, having an improved divider in its operational relationship with the divider support base and a tab display.

SUMMARY OF THE INVENTION

A manual sorter for organizationally separating individual sheets of paper or individual sheets of paper products includes a rigid divider support base, rubber feet for traction, and a plurality of flat, thin, self-supporting dividers movably connected to said divider support base, each of said dividers having a tab holder at its top portion for information display.

The divider support base is essentially an elongated, rigid, rectangular, extruded plate having a pair of C-shaped channels facing each other, disposed along each side of the rigid, flat bottom. The dividers of the flat sorter system have different bottom connection members from the dividers of the vertical system; however, a single divider support base has been constructed that can accommodate either vertical or flat oriented dividers, which is explained in greater detail herein.

With a vertical divider, it is important that it is stable in its vertical position and that it is somewhat movable relative to the support base for access to spacing between dividers.

The information display tab mounted at the top of each divider in the present invention is curved convexly toward the front of the sorter so that indicia tabs bearing numerals or letters of the alphabet can be readily observed from various forward angles adjacent the sorter through the clear, plastic tab by virtue of its curvature.

Each of the dividers for both the vertical and the flat sorters are made of a molded, somewhat rigid plastic that does have some flexibility, but is thick enough so that each divider can be supported in an upright position without bending due to the force of gravity. If flexed, the dividers are sufficiently resilient to return to their original, flat position.

The divider support base can be made of any suitable rigid material, such as metal or hard plastic, or preferably of an extruded aluminum.

FLAT SORTER

The open area of the divider support base receives a plurality of essentially flat and preferably semi-rigid but flexible dividers. The dividers can be made of plastic or similar material. Each divider includes a pair of coaxial divider axles that are transversely oriented to, and sized to slidably fit within, the parallel channels positioned on opposite sides of the flat member. Each of the dividers are held in like manner within the divider support base to form a series of divided areas that extend transverse to the parallel channels of the divider support base.

At the front and rear ends of the divider support base, cross members are placed to retain the dividers within the divider support base. Preferably, at least one of these cross members is removable.

The sorter can be made in other shapes such as circular, for example to set on a round table, which can be rotatable in "lazy susan" manner.

Each divider axle is formed along the bottom edge of the divider and is shaped cylindrically to permit rotation of each divider relative to the support base.

In the flat style-sorter, the dividers may be separated by fixed cylindrical or tubular spacers that extend from one side channel to the other side channel in the divider support base, contacting the bases of adjacent dividers, permitting rotation of each divider.

When the divider is rotated toward the rear end of the divider support base it can become nearly parallel to the flat member and is considered in the closed position. When rotated forward, the divider is considered open to allow a user to appropriately sort the articles by placement into proper divider locations. In addition, the rear cross member, which is positioned in the divider support base, can include an inclined spacer member used to stop the rotation of the plurality of dividers in nearly any desired position when closed. The dividers may therefore be closed when positioned nearly parallel to the divider support base to nearly vertical and perpendicular to the divider support base.

Instead of being completely flat, each divider includes a bent portion that is parallel and adjacent to the axis of the transverse divider axles. The bent portion permits the planar portion of the divider to lie flatter against, and more parallel to, the flat member of the divider support base, when the divider is in the closed position, than would be possible without the bend.

Each divider includes at least one protruding recessed shoulder portion adjacent the transverse divider axle. The recessed shoulder does not protrude as much as the transverse divider axle. The protruding recessed shoulder, and flexibility of the divider, permit the divider to be manually pushed toward, and the recessed shoulder to be firmly inserted into, one of the parallel channels of the divider support base. The protruding recessed shoulder is sized to firmly grip the channel and to prevent movement of the divider, including rotational movement, thereby fixing the position of the divider. When it is desired that the dividers remain open to a specific divider position, the recessed shoulder can be utilized within one of the channels to keep the divider in place.

The front divider can be covered by a front cover that can be made of the same material as the dividers, but thicker or more rigid to form a protective front cover.

Each divider includes an indexing tab preferably positioned on an upper portion of the divider. The indexing tab includes indicia to identify the divider's contents. The indexing tab can be bent in an ergonomic fashion in relation to the planar portion of the divider to make it easier to read the contents of the divider from the front of the sorter and easier to grasp the tab to rotate the associated divider.

VERTICAL SORTER

In one embodiment, the divider is flat without the bent portion, and is mounted vertically in the divider support base. The bottom mount of the vertical divider includes two mounting extends between edges 10 and 11, and into channels 12 and 13. Channels 12 and 13 are parallel to each other and extend the full length of divider support base 2.

Divider support base 2 is a flat plate (linear or circular) made of any suitable material such as metal or plastic, and is preferably aluminum. Divider support base 2 can be made of one piece by extrusion or with separate members connected together.

Referring to FIG. 5, each divider 4 is essentially planar and preferably made of a plastic material that is semi-rigid but flexible. Divider 4 includes a pair of divider axles 16 and 17 at the lower end, that are cylindrical in shape and positioned coaxially on opposite sides of divider 4. Divider 4 also includes a pair of protruding recessed shoulders 18 and 19, adjacent divider axles 16 and 17, respectively. Divider 4 may alternately include only one recessed shoulder 18 or 19. The axles also function as spacers.

Divider 4 includes an indexing tab 20, which can form a transparent envelope attached to the end of divider 4 opposite divider axles 16 and 17 by suitable fasteners such as eyelets 21.

Referring to FIG. 6, an identification index (not shown) can be inserted into the hollow center of indexing tab 20. Alternately, indexing tab 20 can be other than transparent and contain identification indicia. Indexing tab 20 can alternately be unitarily made as part of divider 4 instead of being a separate and attached member.

Divider 4 is essentially planar but can have bend 22, as shown in FIGS. 5 and 6, to help divider 4 lie flat when in the closed position shown in FIG. 1. Indexing tab 20 can also include a bend, as shown in FIG. 6, ergonomically placed to improve grasping by an operator and to improve reading of identification indicia.

Referring to FIG. 7, divider 4 is slidably mounted into the open area 15 on the upper portion of divider support base 2. Dividing axles 16 and 17 of divider 4 extend transverse to the length of divider support base 2, and are received into channels 12 and 13 respectively. Referring back to FIG. 1, the length of divider support base 2 is preselected and the number of dividers 2 are preselected. Cross member 5 and/or cross member 6 can be removable to permit adding or removing dividers within a given divider support base size. Because dividers 4 are slidably mounted within divider support base 2, the space between adjacent dividers 4 is preselected to accommodate articles of a given thickness.

Dividing axles 16 and 17 further permit divider 4 to rotate about the transverse axis of divider axles 16 and 17 within channels 12 and 13. Rotation about divider axles 16 and 17 allows dividers 4 to be positioned between a closed position, as shown in FIG. 1, to an open position to place items to be sorted in the appropriate spaces between dividers 4.

To maintain dividers 4 in the open position, recessed shoulder 18 or recessed shoulder 19 is slid into channel 12 or channel 13, respectively. Recessed shoulder 18 or recessed shoulder 19 is sized to forcibly engage channel 12 or 13 to prevent slidable and rotational movement of divider 4 in relation to divider support base 2, thus locking divider 4 in place in the open position. Bend 22 on divider 4 additionally helps position recessed shoulders 18 and 19 into channels 12 and 13, respectively Referring to FIG. 8, an alternate embodiment of the present invention is shown where divider support base 2 is replaced with a circular divider support base 24. Cross member 6 is not utilized in this embodiment, and therefore dividers 4 lie flat and essentially parallel to divider support base 24 when in the closed position. Table 25 can be utilized to hold divider support base 24, and can be rotatable for user convenience.

Referring to FIG. 9, an alternate embodiment of the present invention can include the addition of a pair of flared members 26 attached to the divider support base to permit the invention to attach to a table 27. In this embodiment, the dividers 40 can be maintained in an essentially vertical position as shown. rectangular blocks having end segments that fit into the divider support base side channels. A slight rotational movement is permitted. Each vertical divider is self-standing because of the mounting blocks.

Accordingly, it is an object of the present invention to provide a manual sorter that includes a plurality of dividers which are slidably expandable in relation to each other to accommodate articles of varying thickness.

It is another object of the present invention to provide a manual sorter that includes dividers that rotate from an open to a closed position and that have a protruding recessed shoulder insertable into a channel in a divider support base to positively stop the rotation of the divider in a desired position.

It is a further object of the present invention to provide a manual sorter that includes a divider support base that can be made of a preselected length to retain any desired number of dividers.

In accordance with these and other objects which will become apparent hereinafter, the instant invention will now be described with particular reference to the accompanying drawings.

DESCRIPTION OF THE PREFERRED EMBODIMENTS

Figure 1:
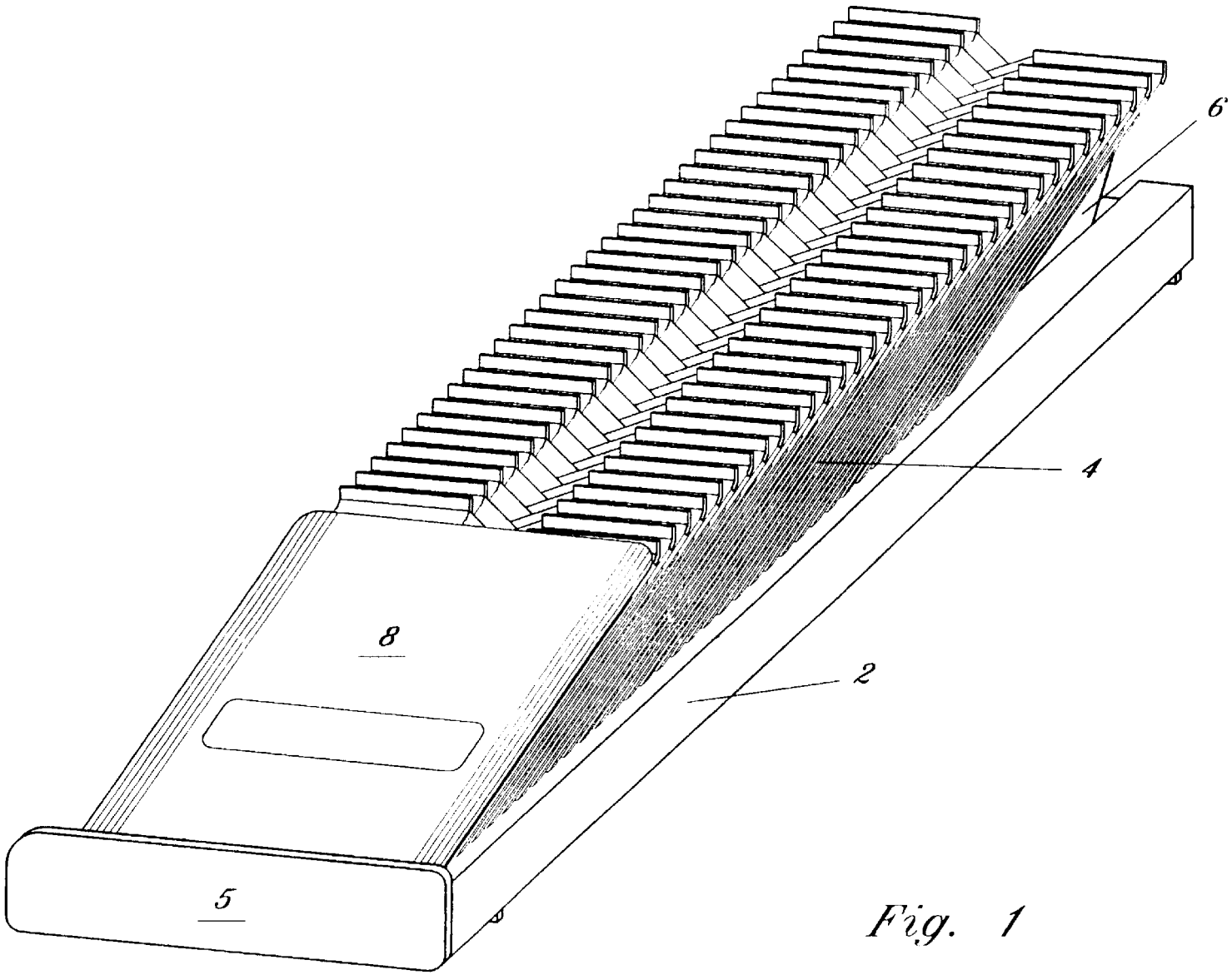
FIG. 1 perspective view of one embodiment of the present invention.

Referring to FIG. 1, one embodiment of the present invention includes a rectangular divider support base 2 holding a plurality of dividers 4. Divider support base 2 includes front cross member 5 and rear cross member 6 both of which retain the dividers 4 within divider support base 2. Rear cross member 6 can include an inclined spacer for dividers 4 to lie against when in the closed position as shown. Front cover 8 may be included to protect the front most divider.

Figure 2:
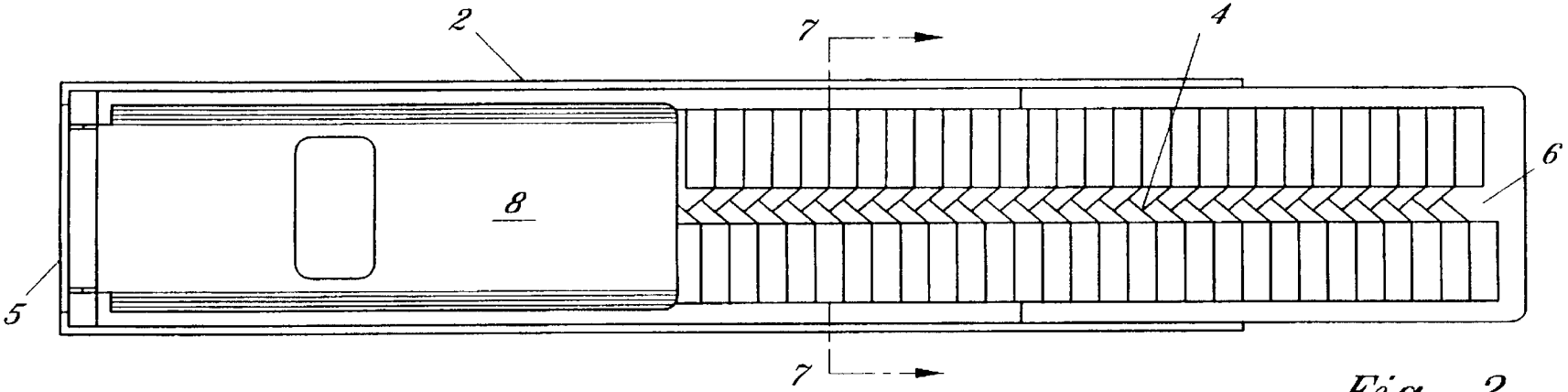
FIG. 2 is a top plan view of the embodiment of FIG. 1.
Figure 3:
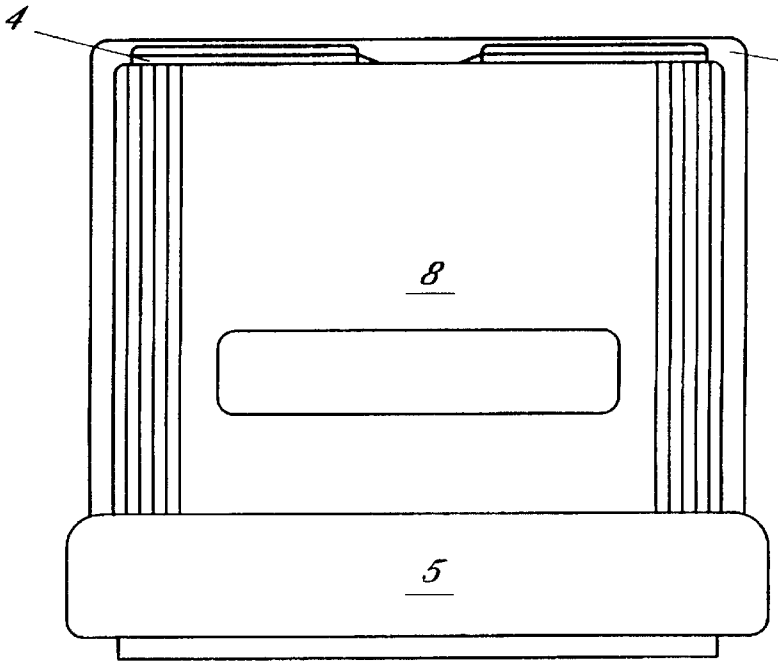
FIG. 3 is a front elevational view of the embodiment of FIG. 1.

FIGS. 2 and 3 show top and front views, respectively, of the embodiment of FIG. 1. The width and length of the present invention can be selected to be nearly any desirable size to accommodate articles of any size, and to hold any number of dividers 4, and hence any number of articles.

Divider support base 2 is shown essentially rectangular as example only, the invention is not intended to be limited to a rectangular shape.

Figure 4:
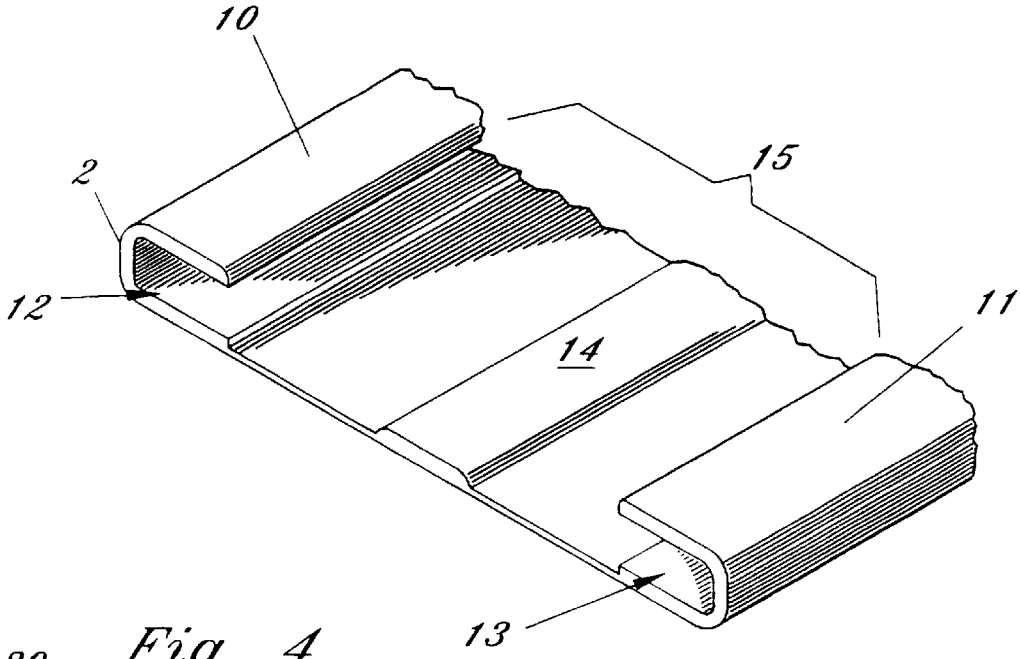
FIG. 4 is partial front perspective view of the divider support base of present invention.
Figure 5:
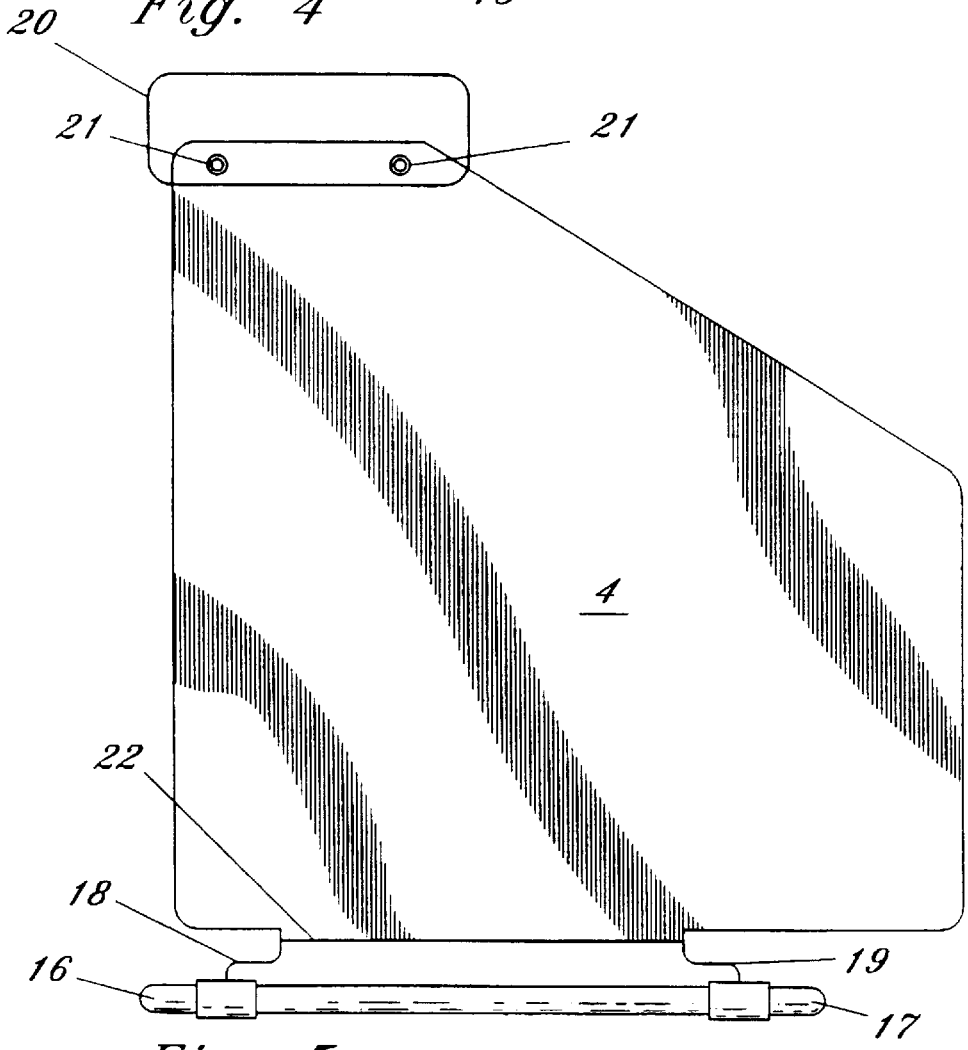
FIG. 5 is a front elevational view of the divider of the present invention.
Figure 7:
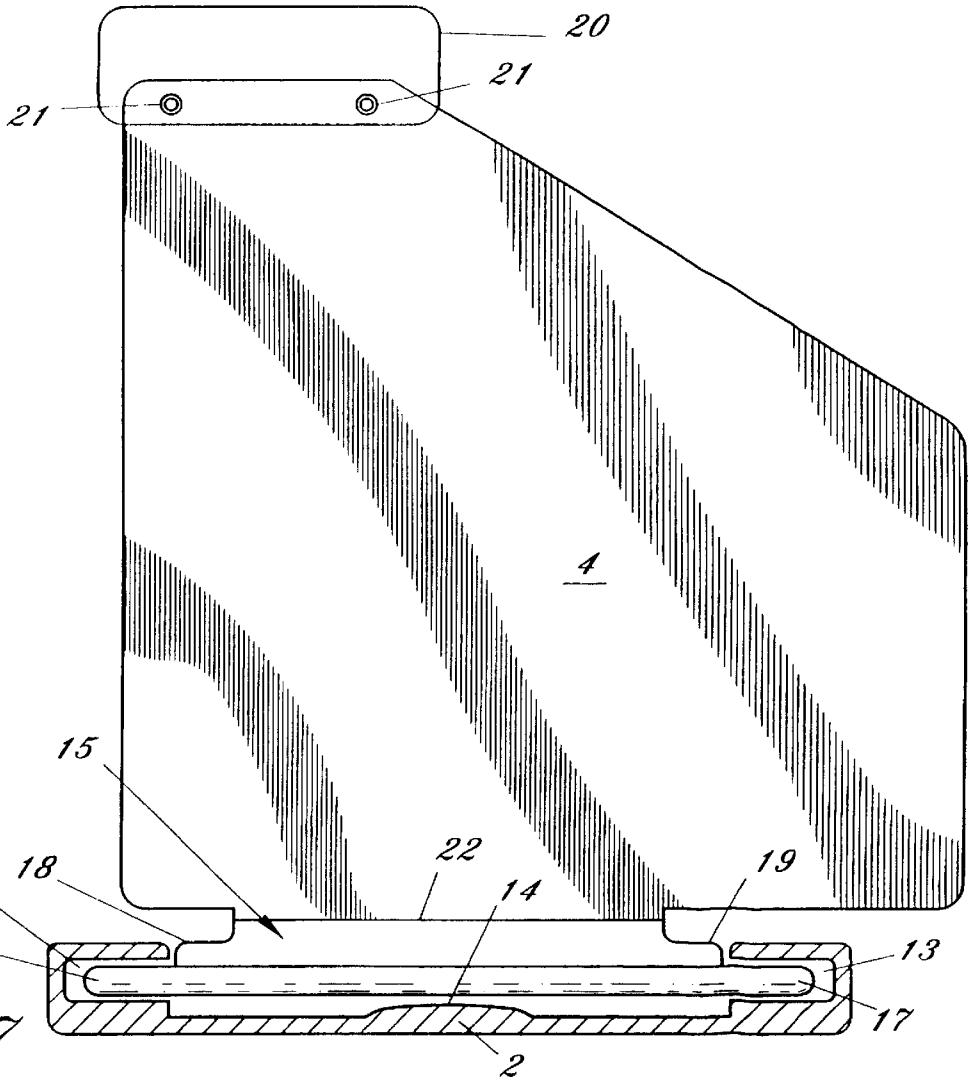
FIG. 7 is a partial cross-sectional view taken along line 7—7 of FIG. 3.
Figure 6:
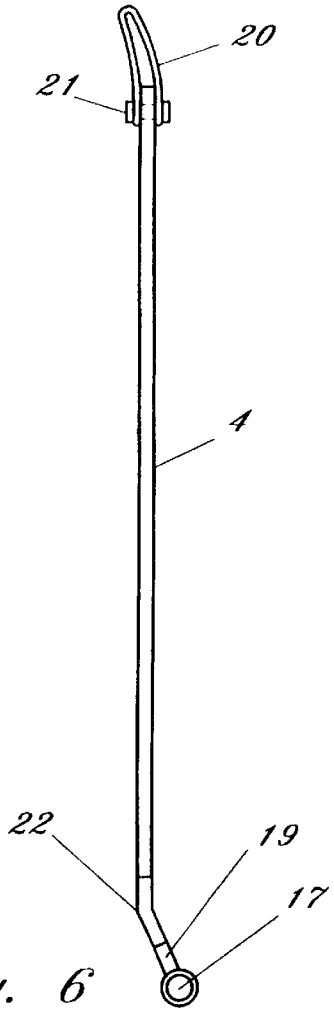
FIG. 6 is right side elevational view of the divider of FIG. 5.
Figure 8:
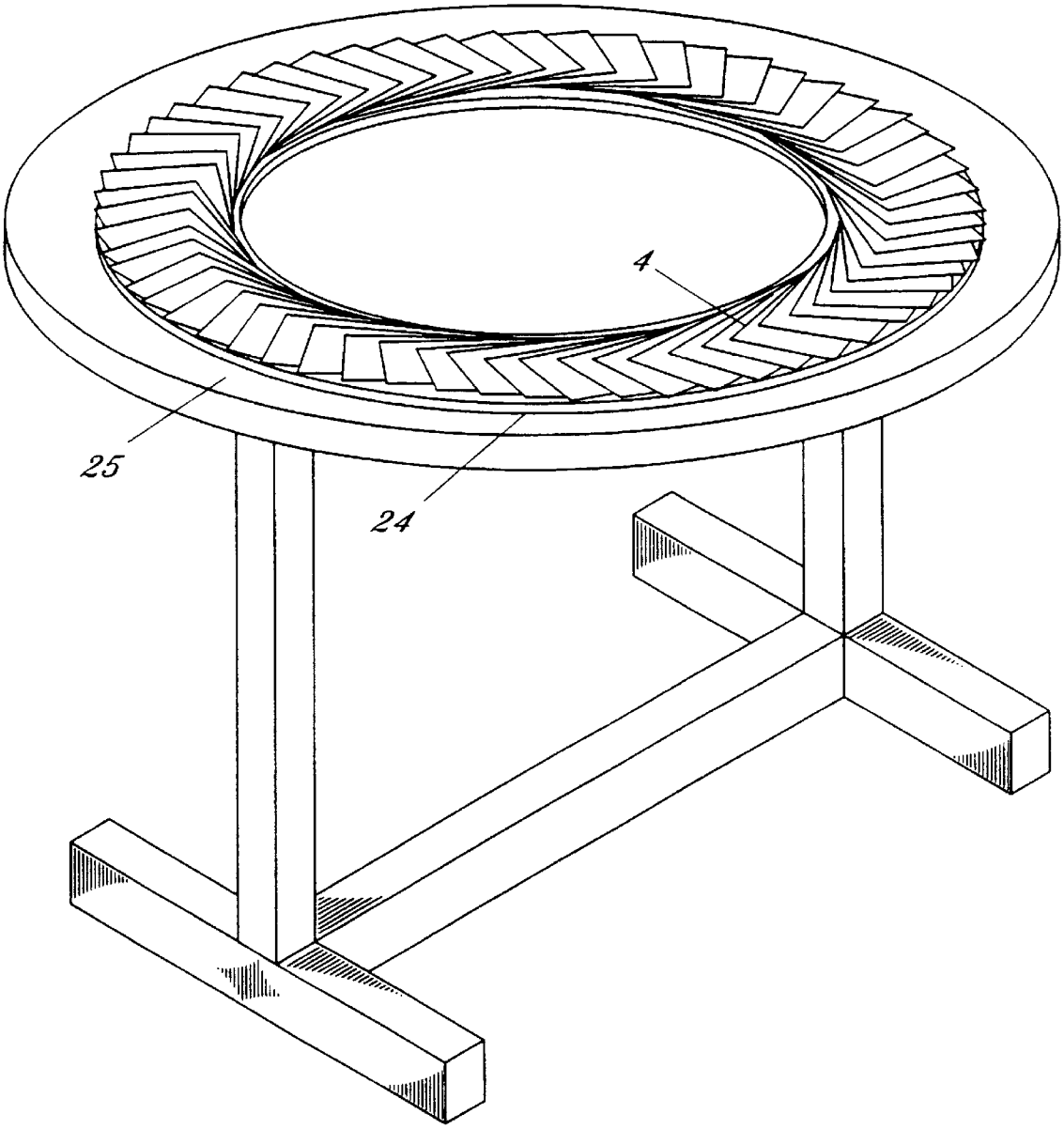
FIG. 8 is a perspective view of an alternate embodiment of the present invention.
Figure 9:
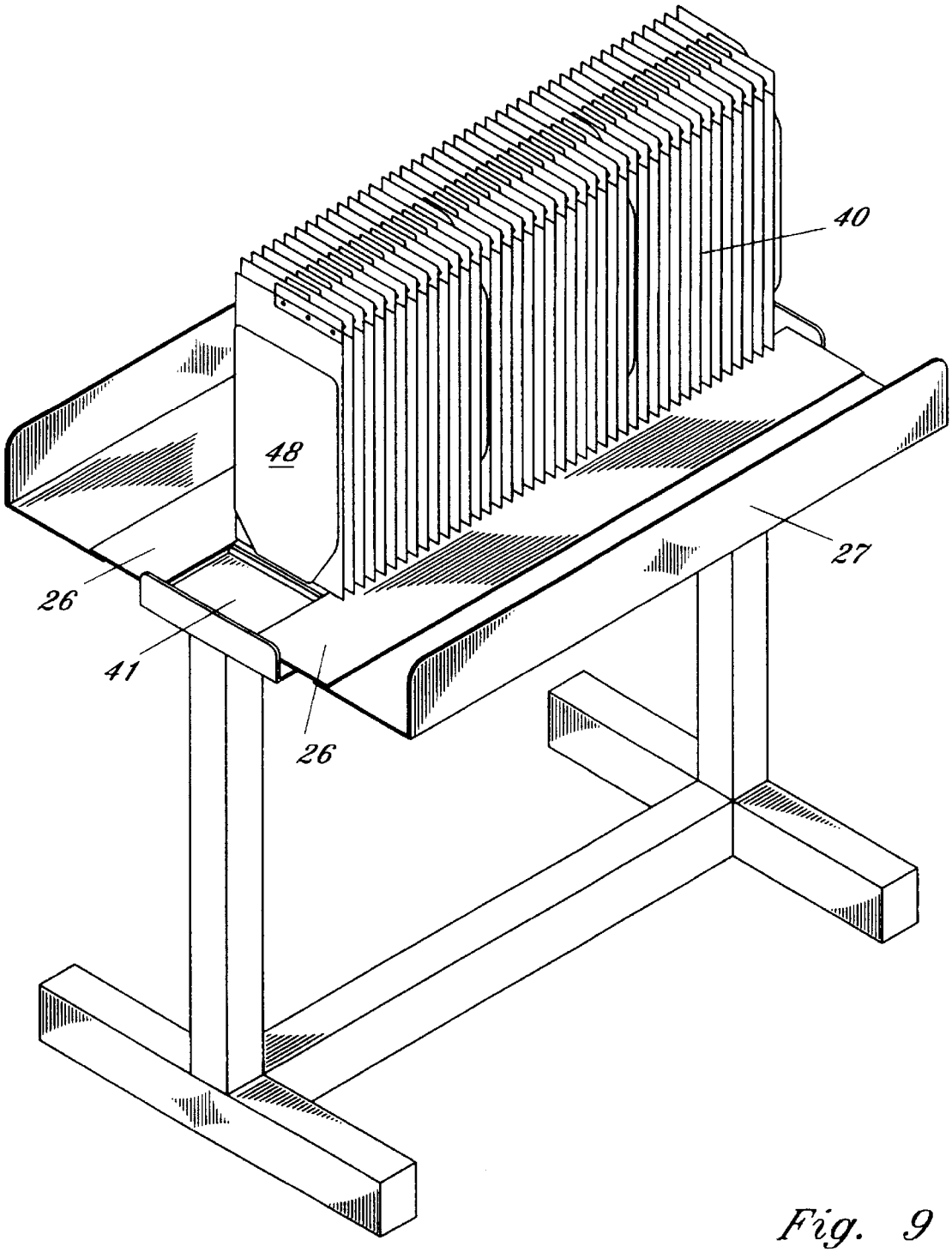
FIG. 9 is a perspective view of an alternate embodiment of the present invention.
Figure 11:
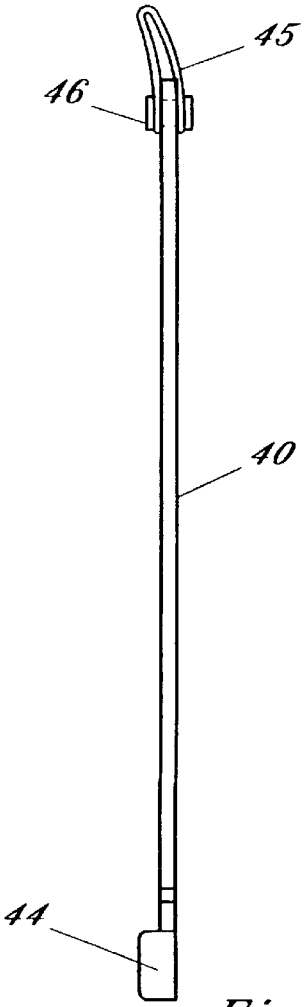
FIG. 11 is a right side elevational view of the divider of FIG. 10.
Figure 10:
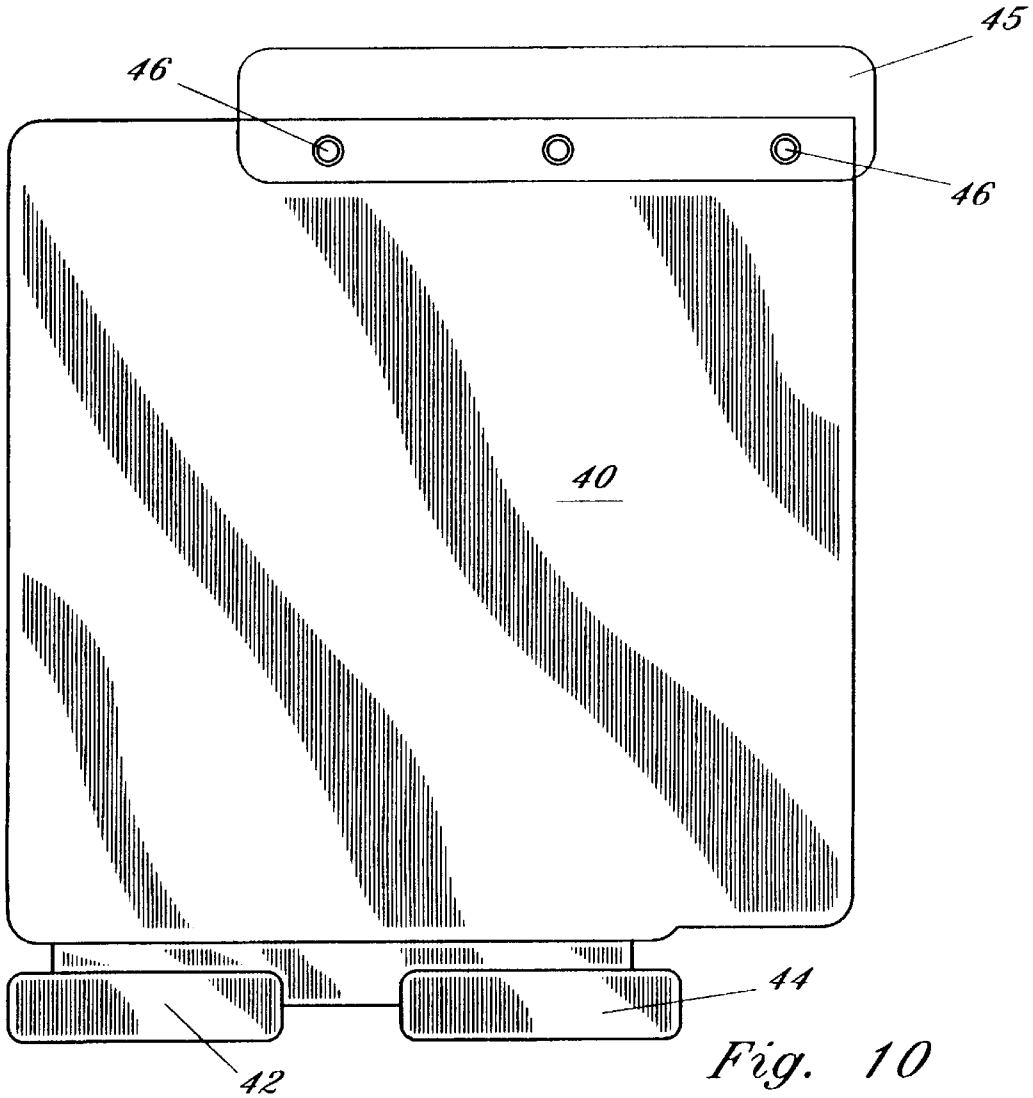
FIG. 10 is a front elevational view of the divider of the embodiment of FIG. 9.
Figure 12:
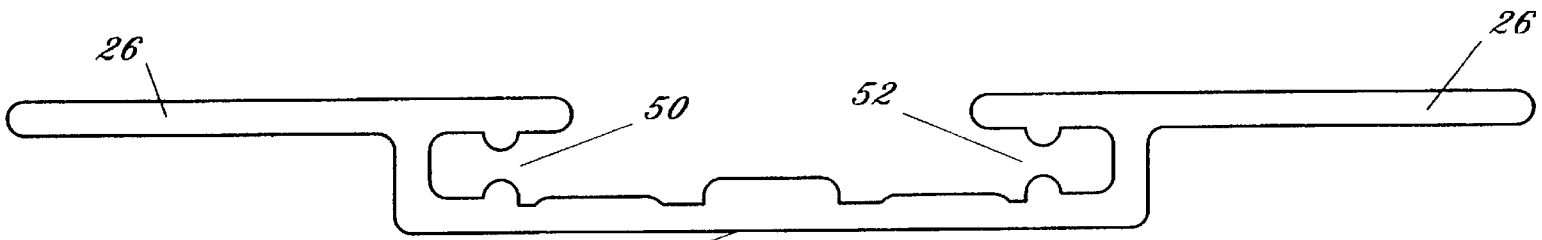
FIG. 12 is a front elevational view of the divider support base for the embodiment of FIG. 10.

Referring to FIG. 4, divider support base 2 includes lateral edges 10 and 11 which are upturned forming side C-shaped channels 12 and 13. Upturned edges 10 and 11 face each other over the top of flat member 14 to form an open area 15 which Referring to FIGS. 10 and 11, the dividers 40 utilized for vertical positioned embodiments, as shown in the example of FIG. 9, are flat without a bend adjacent the lower portion. In addition, divider axles 42 and 44 are mounting blocks that are rectangular in cross-section. Divider support base 41, similar to divider support base 2 and shown in FIG. 12, is sized to slidably receive divider axles 42 and 44 in like manner to receiving divider axles 16 and 17 shown in FIG. 7. Divider support base 41 includes channels 50 and 52 which slidably receive divider axles 42 and 44 respectively. Dividers 40 thus are slidably adjustable within divider support base 41.

Dividers 40 do not rotate about divider axles 42 and 44 as dividers 4 rotate about divider axles 16 and 17. However, it is desirable to provide enough rotational movement in dividers 40 to permit approximately a ten degree (10°) angle from vertical to aide the user in sorting.

Dividers 40 can include a transparent indexing tab 45 attached by eyelets 46, or alternately can include a solid indexing tab in which indexing indicia can be affixed.

Figure 13:
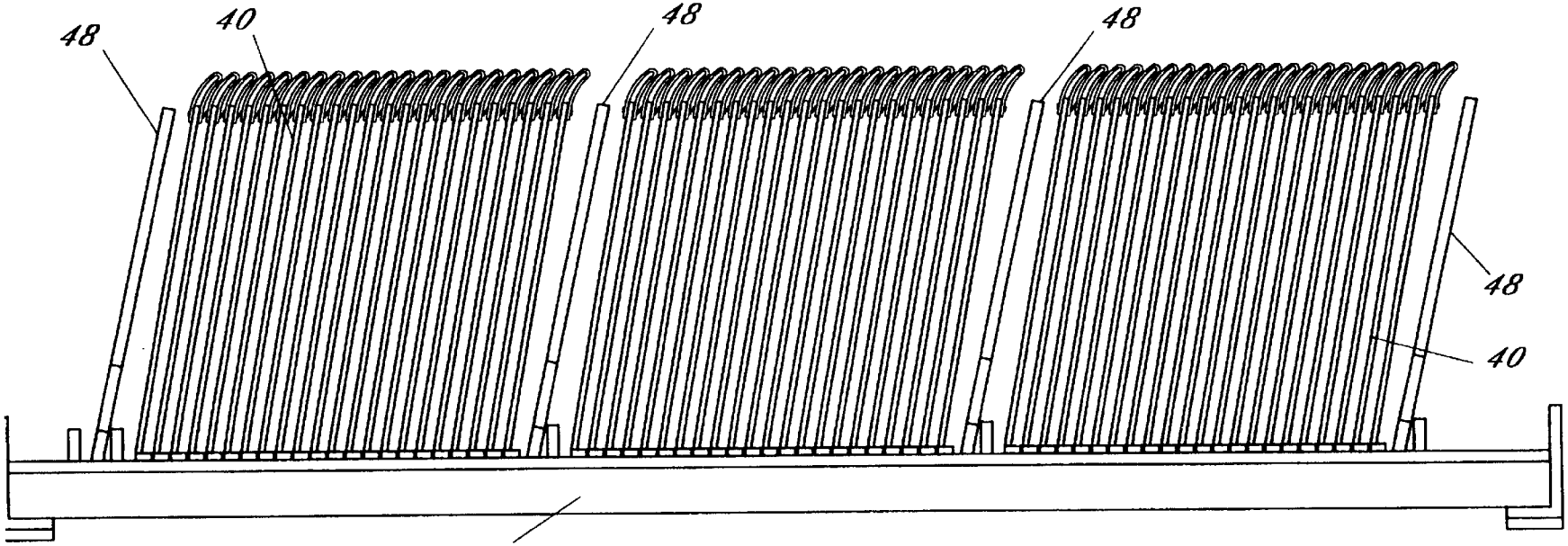
FIG. 13 is a side elevational view of the embodiment of FIG. 9.

Referring to FIG. 13, one or more support dividers 48 can be placed between dividers 40. A preselected amount of space is provided between adjacent dividers 40 to accommodate the user's sorting requirements.

Other embodiments of the present invention are contemplated herein, but will not be individually described.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A manual sorting apparatus of the type that includes a plurality of dividers held within a divider support base, comprising:

a divider support base having an essentially planar lower member with a front end, a rear end, a left edge and a right edge;

said left edge and said right edge both upturned and facing each other forming a pair of essentially C-shaped parallel channels, said pair of essentially C-shaped parallel channels each extending from said front end to said rear end;

said left edge and said right edge defining an open area between said edges and above said planar lower member, and extending into said pair of essentially C-shaped parallel channels;

a plurality of essentially planar dividers, each having an upper portion and a lower portion;

each divider of said plurality of essentially planar dividers having a pair of coaxial divider axles adjacent said lower portion;

each divider of said plurality of dividers adapted to be slidably receivable within said open area of said divider support base, wherein one each of said divider axles being slidably receivable within one each of said pair of essentially C-shaped parallel channels, and an axis of said divider axles of each of said plurality of dividers being transverse to each of said pair of essentially C-shaped parallel channels;

each divider of said plurality of dividers being rotatable about said axis of said divider axles between a first and a second position;

each divider of said plurality of dividers having at least one protruding recessed shoulder adjacent at least one of said divider axles, said at least one protruding recessed shoulder adapted to be insertable within one of said essentially C-shaped parallel channels when at least one of said plurality of dividers is in said second position to prevent said at least one of said plurality of dividers from rotation back to said first position, essentially locking said at least one of said plurality of dividers in place in said second position.

2. The manual sorting apparatus of claim 1 wherein each of said plurality of dividers includes a bend parallel to said axis of said divider axles and adjacent said lower portion.

3. The manual sorting apparatus of claim 1 wherein said divider support base is essentially rectangular and elongated in length a preselected amount.

4. The manual sorting apparatus of claim 1 further including a front cover adjacent said front end.

5. The manual sorting apparatus of claim 1 wherein each of said plurality of dividers includes means for indexing with indicia to identify articles to be sorted, said means mounted adjacent said upper portion.

6. The manual sorting apparatus of claim 5 wherein said means for indexing includes a tab member having a bend relative to said planar divider.

7. The manual sorting apparatus of claim 1 further including:

a front cross member mounted to said divider support base adjacent said front end;

a rear cross member mounted to said divider support base adjacent said rear end;

said front cross member and said rear cross member both including means to prevent said plurality of dividers from slidable removal from said divider support base.

8. The manual sorting apparatus of claim 7 wherein at least one of said front cross member and said rear cross member is removably mounted to said divider support base.

9. The manual sorting apparatus of claim 7 wherein said rear cross member includes an inclined surface to position said plurality of dividers in a preselected position when said plurality of dividers are in said first position.

10. The manual sorting apparatus of claim 9 wherein said divider support base is circular, said front end and said rear end being connected together.

* * * * *